United States Patent [19]

Stageberg, deceased et al.

[11] 4,443,167

[45] Apr. 17, 1984

[54] ROTARY FLUID PUMP MECHANISM

[76] Inventors: Sterling O. Stageberg, deceased, late of St. Petersburg, Fla.; Edward A. Linney, legal representative, 1513 4th Street North, St. Petersburg, Fla. 33704

[21] Appl. No.: 294,753

[22] Filed: Aug. 20, 1981

[51] Int. Cl.[3] ..... F04C 5/00; F04C 15/00

[52] U.S. Cl. ..... 418/91; 418/104; 418/154; 418/172

[58] Field of Search ..... 418/45, 91, 104, 172, 418/1.54, 156

[56] References Cited

U.S. PATENT DOCUMENTS

| | | | |
|---|---|---|---|
| 1,818,430 | 8/1931 | Ricardo | 418/172 |
| 2,882,830 | 4/1959 | McDuffie | 418/154 |
| 3,133,506 | 5/1964 | Luciani | 418/91 |
| 3,202,103 | 8/1965 | Sully | 418/154 |
| 3,218,983 | 11/1965 | Parrett | 418/154 |
| 3,544,243 | 12/1970 | Stageberg | 418/58 |
| 3,712,765 | 1/1973 | Smith | 418/154 |

FOREIGN PATENT DOCUMENTS

| | | | |
|---|---|---|---|
| 790116 | 2/1958 | United Kingdom | 418/156 |
| 857530 | 12/1960 | United Kingdom | 418/154 |

*Primary Examiner*—John J. Vrablik

*Attorney, Agent, or Firm*—Frijouf, Rust & Pyle

[57] ABSTRACT

A fluid pump for pumping a fluid from an input conduit to an output conduit comprising a housing having a cup-shaped rotor assembly rotatably disposed within the housing. A vane ring assembly is slidably disposed within the rotor assembly. A protuberance on the vane ring engages a corresponding indentation disposed on an inner and outer cup to prevent the vane ring assembly from rotating within the rotor assembly. A hub assembly is disposed within the vane ring assembly such that the axis of the hub assembly is parallel and eccentric to the axis of rotation of the vane ring assembly. A wear plate is in juxtaposition with the open end of the rotor assembly and a plurality of band-shaped vanes interconnect the vane ring assembly and the hub assembly. The vanes are disposed in a spaced-apart relationship parallel to the axis of rotation of the vane ring assembly to form a plurality of pump chambers. Each of the pump chambers is defined by two of the vanes, the bottom of the rotor assembly and the inner surface of the wear plate such that the volume of the pump chambers sequentially increases and decreases as the vane ring assembly is rotated. An input port is connected in fluid communication with the pump chambers when the pump chambers are increasing in volume and an output port is connected with the pump chambers when the pump chambers are decreasing in volume as the vane ring assembly is rotated. The input and output ports are connected to input and output conduits, respectively.

25 Claims, 5 Drawing Figures

ROTARY FLUID PUMP MECHANISM

BACKGROUND OF THE INVENTION

1. Field of the Invention

This invention relates to rotary displacement devices such as fluid pumps or motors. More particularly, this invention relates to improvements to the rotary fluid pump mechanism disclosed in U.S. Pat. No. 3,544,243.

2. Description of the Prior Art

U.S. Pat. No. 3,544,243 discloses a rotary fluid pump mechanism comprising a housing formed by a generally drum-shaped member having an end assembly secured across an open end thereof. A pump drive shaft is journalled within the housing to rotate a pump assembly therein. The pump assembly comprises a rotor assembly secured to the proximal end of the drive shaft. A hub structure is rotatably disposed within the rotor assembly by means of a rotor pin connected to the end assembly. The axis of rotation of the hub assembly is positioned eccentric to the axis of rotation of the rotor assembly. A plurality of vanes interconnect the rotor assembly and the hub assembly. The edges of the vanes seal against the bottom of the rotor assembly and against a wear plate connected to the end assembly in juxtaposition with the open end of the rotor assembly, thereby creating a plurality of pump chambers. An input port and an output port are connected to the end assembly and through the wear plate to be in fluid communication with the pump chambers as the pump chambers cyclically increase and decrease in volume, respectivley, as the rotor assembly and the hub assembly is rotated.

The patented pump as disclosed above has worked quite satisfactorily in a great multitude of applications and environments. Moreover, the operating life of the patented pump has been adequately long, and has been somewhat increased by manufacturing the pumps, particularly the vanes, from state-of-the-art materials. Unfortunately, there have been a number of problems associated with the patented pump which have rendered the pump unsuitable for use in some applications.

One problem associated with the patented pump has been a substantial amount of leakage between the drive shaft and the housing. This occurs primarily when the pump is operating at relatively high speeds. The most prevalent problem, however, has been excessive wearing of the vanes of the hub assembly during operation. After long operation, the edges of the vanes tend to become torn as they wrap about the rotor blocks of the hub assembly thereby preventing the vanes from forming an adequate seal against the bottom of the rotor assembly and against the wear plate. To repair the patented pump the entire pump assembly including the rotor assembly and the hub assembly must be replaced with a new pump mechanism. Accordingly, it is almost just as economical to replace the entire pump instead of rebuilding or repairing a used pump.

Therefore it is an object of this invention to provide an apparatus which overcomes the aforementioned inadequacies of the prior art devices and provides an improvement which is a significant contribution to the advancement of the fluid pumping art.

Another object of this invention is to provide a fluid pump including means for preventing leakage between the drive shaft and the housing of the pump when the pump is operating at relatively high speeds.

Another object of this invention is to provide a fluid pump having a replaceable rotor assembly to facilitate the rebuilding or repair of a worn pump.

Another object of this invention is to provide a fluid pump having specially contoured rotor blocks which substantially reduce the amount of wear of the vanes as the vanes wrap about the rotor block during operation of the pump.

Another object of this invention is to provide a fluid pump having an input port and an output port disposed through the wear plate to be in fluid communication with the pump chambers as the pump chambers cyclically increase and decrease in volume, respectively, during operation of the pump.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings and explained in the detailed discussion. For the purpose of summarizing the invention, the invention basically comprises improvements to the rotary fluid pump mechanism described in U.S. Pat. No. 3,544,243. More specifically, these improvments enhance the pumping capabilities of the fluid pump, increase the operating life of the fluid pump, and enables the fluid pump to be economically rebuilt and repaired when necessary.

One improvement comprises a unique seal unit within the sleeve of the housing which prevents leakage between the drive shaft and the sleeve itself. The seal unit includes a sealing gasket which is pressed against the inner surface of the drive shaft bearing and the inside surface of the sleeve by means of a helical compression spring. Means are provided for enabling the sealing gasket to rotate with respect to the drive shaft such that a static seal is always formed between the drive shaft bearing and the sleeve.

Another improvement comprises the redesign of the rotor blocks which secure the plurality of vanes of the hub assembly. The rotor blocks include a configuration which substantially reduces the amount of wear to the vanes as the vanes wrap about the rotor blocks during operation of the pump, thereby greatly increasing the operating life of the pump. The rotor blocks are fastened to the hub of the hub assembly by means of a threaded fastener disposed through a rotor block spacer. The rotor block spacer enables the threaded fastener to more rigidly secure the rotor blocks and correspondingly, the vanes, to the hub without deforming the rotor blocks themselves. A more uniform seal is therefore attained by the vanes pressing against the bottom of the rotor assembly and the wear plate. Leakage between adjoining pump chambers is therefore substantially eliminated. In order to increase the operating life of the hub assembly rotating on the rotor pin, a grease fitting is provided which enables a lubricant to be injected into the wearing surfaces of the hub assembly.

A further improvement of the invention comprises a vane ring assembly slidably disposed within the cup-shaped rotor assembly. The removable vane ring assembly enables the fluid pump to be easily rebuilt by replacing a worn out vane ring assembly (together with the worn vanes and hub assembly) with a new vane ring assembly. All of the components of the fluid pump which tend to be quickly worn out, can therefore be easily replaced at an economical cost without having to discard the entire fluid pump.

A still further improvement of the invention comprises the particular configuration of the input and output ports located through the wear plate. Specifically, the input and output ports have been redesigned to increase the pumping capabilities of the fluid pump, and also to increase the amount of time which the fluid pump can be operated dry and initiate pumping without the need for priming.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
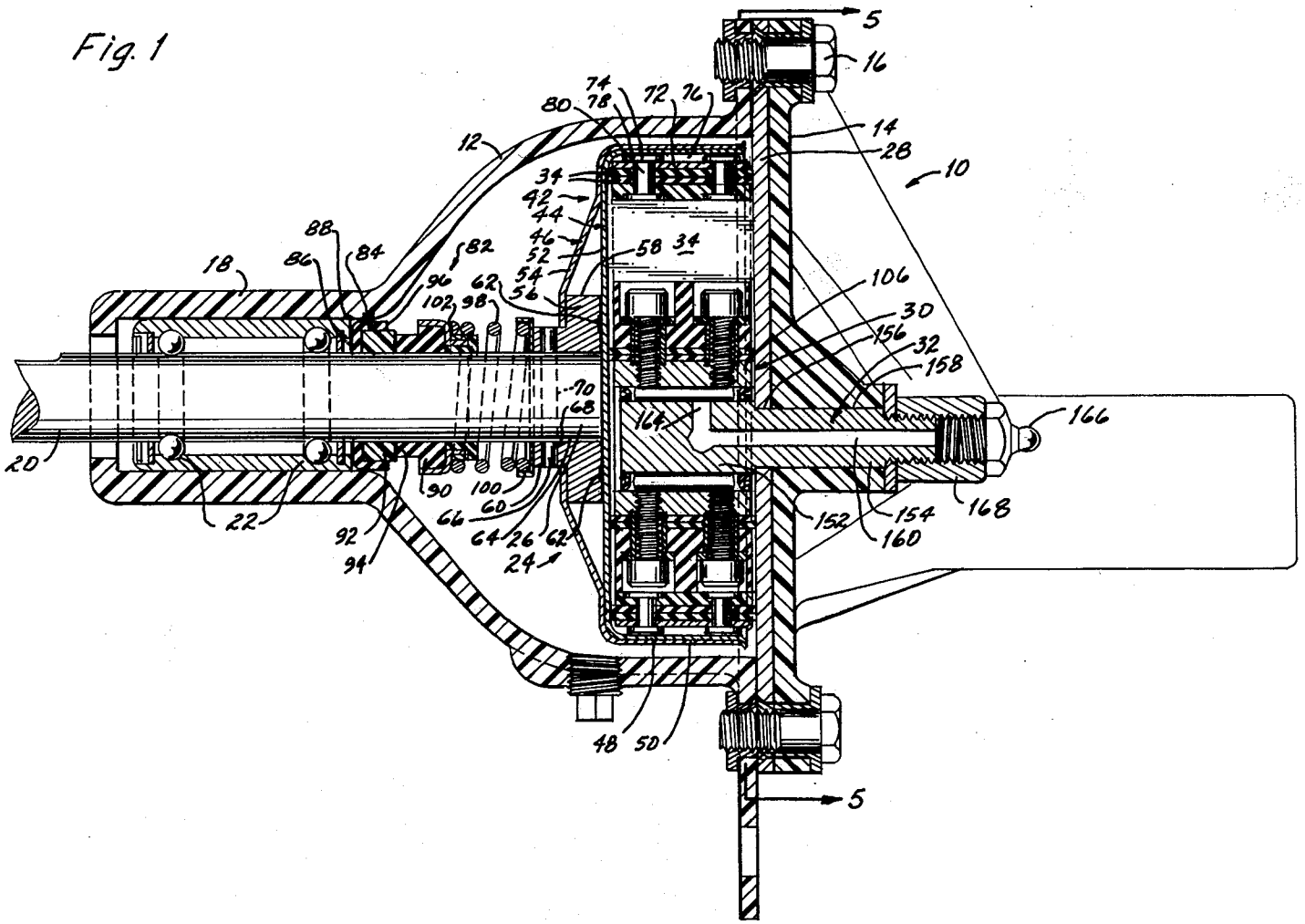
FIG. 1 is a cross-sectional view of the fluid pump of the invention.
Figure 2:
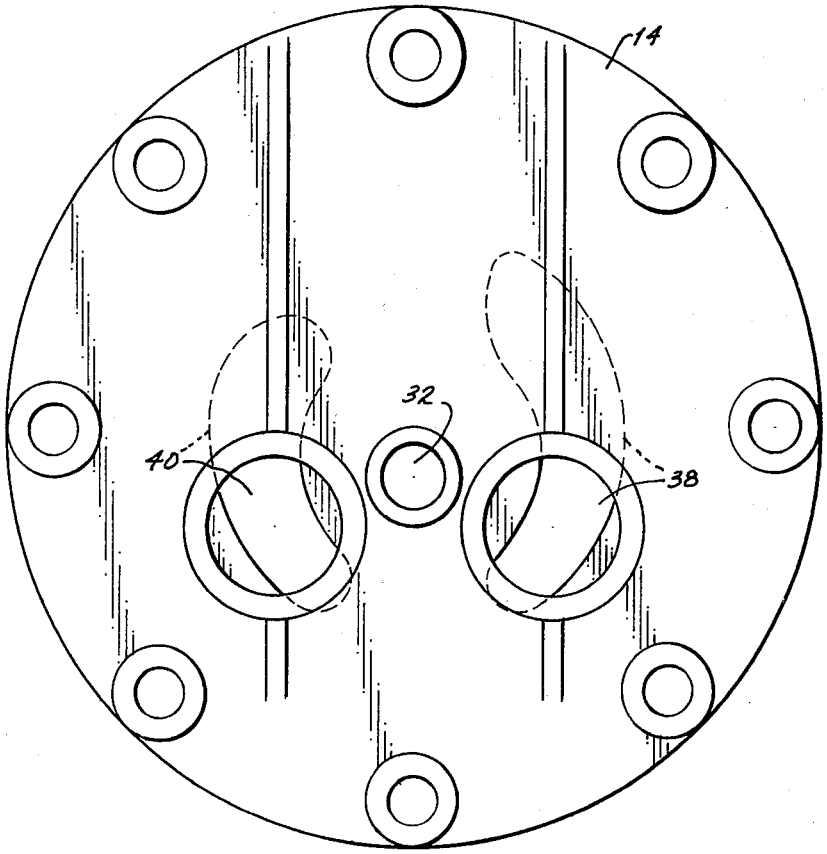
FIG. 2 is a frontal view of the fluid pump illustrating the location of the input and output conduits in relation to the input and output ports, respectively.

This invention includes several improvements of the rotary fluid pump mechanism described in U.S. Pat. No. 3,544,243, which is hereby incorporated by reference. To the extent possible, the detailed description of the subject invention adopts the terminology used in U.S. Pat. No. 3,544,243.

Basically, the fluid pump 10 of this invention comprises a drum-shaped housing 12 having one end open-ended. The end assembly 14 is connected to the open end of the housing 12 by means of threaded fasteners 16. A sleeve 18 is integrally molded to the other end of housing 12. A drive shaft 20 is rotatably journalled within the sleeve 18 by means of a bearing 22. A rotor assembly 24 is connected to the proximal end 26 of the drive shaft 20. A wear plate 28 is connected by the end assembly 14 in juxtaposition with the opened end of the rotor assembly 24. A hub assembly 30 is positioned within the rotor assembly 24 by means of a rotor pin 32 connected to the end assembly 14. The axis of the rotor pin 32 and correspondingly, the hub assembly 30 are positioned parallel and eccentric to the axis of rotation of the rotor assembly 24. A plurality of band-shaped vanes 34 interconnect the hub assembly 30 and the side of the rotor assembly 24. Each pair of vanes 34 define pump chambers 36 whose volume sequentially increase and decrease as the rotor assembly is rotated via drive shaft 20. An input port 38 is connected in fluid communication with pump chambers 36 when the pump chambers 36 are increasing in volume as the rotor assembly 24 is rotated. Similarly, an output port 40 is incorporated within the end assembly 14 in fluid communication with pump chambers 36 when the pump chambers 36 are decreasing in volume as the rotor assembly 24 is rotated. During operation, the fluid to be pumped is drawn into the pump chambers 36 during their increase-in-volume cycle via input port 38 and then discharged via output port 40 during the decreasing-in-volume cycle of the pump chambers 36.

Removable Vane Ring

Figure 3:
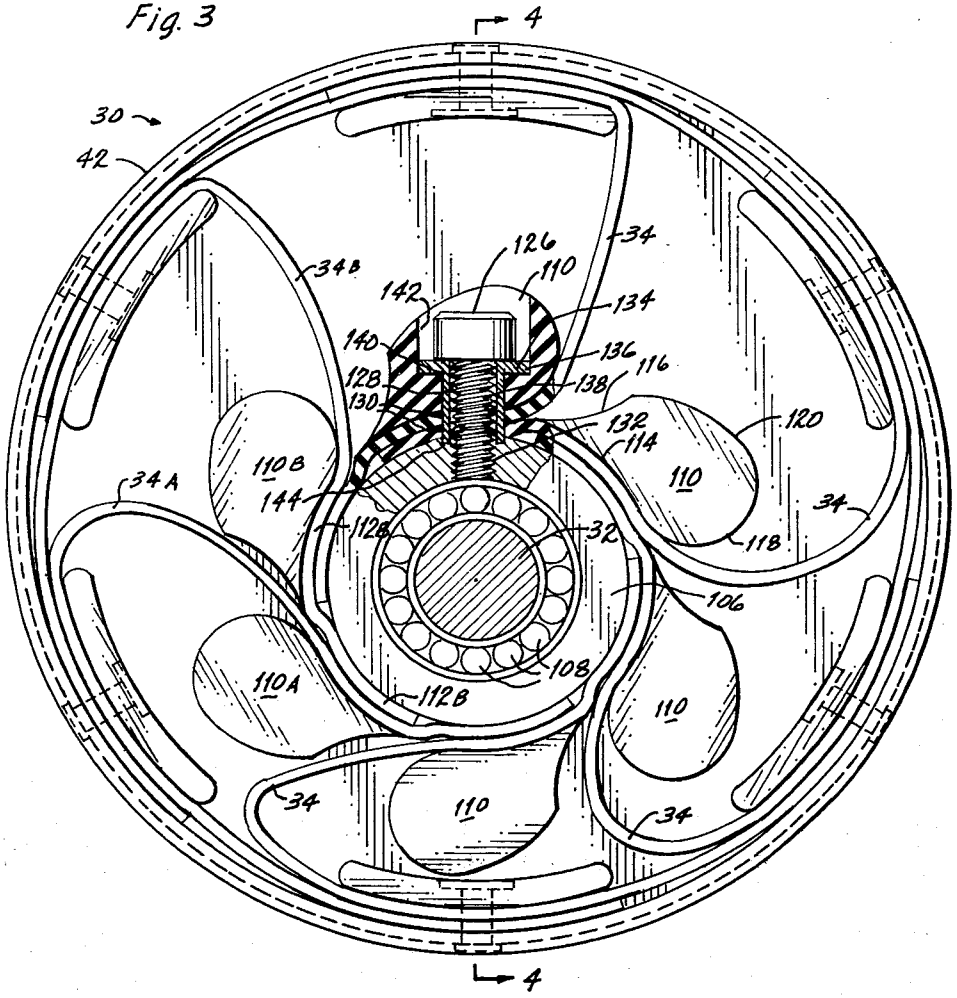
FIG. 3 is a cross-sectional view of the rotor assembly and the hub assembly of the fluid pump illustrating the pump chambers formed by the plurality of vanes.
Figure 4:
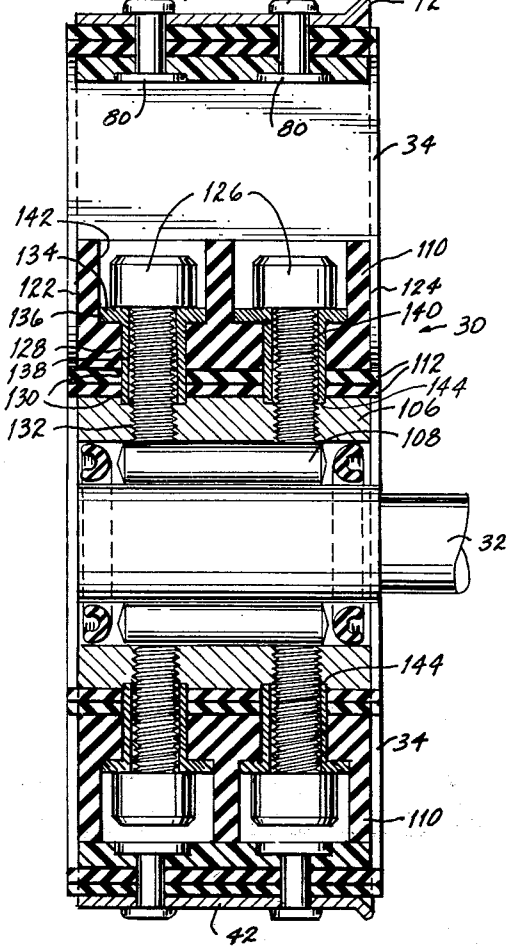
FIG. 4 is an enlarged cross-sectional view of the removable vane ring assembly together with the hub assembly.

FIGS. 1, 3 and 4 illustrate rotor assembly 24 of the invention. More particularly, the rotor assembly 24 comprises an inner cup 44 located within an outer cup 46. Both of the cups 44 and 46 include a substantially cup-shaped cylindrical configuration including sidewalls 48 and 50 and bottoms 52 and 54, respectively. A hub 56 is provided for interconnecting the inner and outer cups 44 and 46 together and for connecting the vane ring assembly 42 to the proximal end 26 of the drive shaft 20. Specifically, hub 56 comprises a major hub portion 58 and a minor hub portion 60. The inner and outer cups 44 and 46 are connected about the major hub portion 58 by means of spot welds 62. The proximal end 26 of the drive shaft 20 slidably engages within blind aperture 64 in the minor hub portion 60. A fastener means such as a roll pin 66 is provided for rigidly connecting the rotor assembly 24 to the proximal end 26 to the drive shaft 20. Specifically, the roll pin 66 engages through aperture 68 in the minor hub portion 60 and a corresponding aperture 70 within the proximal end 26 of the drive shaft 20. It should be understood, however, other fastener means such as keyways or welds may be provided for rigidly securing the vane ring assembly 42 to the drive shaft 20 without departing from the spirit and scope of this invention.

A removable vane ring 72 having a substantially cylindrical configuration is provided for insertion within the inner cup 44 of the removable vane ring assembly 42. The vane ring 72 includes a protuberance 74 extending away from its outer surface. The protuberance 74 engages with a corresponding indentation 76 disposed on the inner cup 44 and the outer cub 46. The protuberance 74 and the indentation 76 operate together to prevent rotation of the vane ring 72 with respect to the inner cup 44 and the outer cup 46. In the preferred embodiment, protuberance 74 comprises the end 78 of a fastener means 80 which secures the distal end of the vanes 34 to the vane ring 72.

It should be appreciated that the removable vane ring assembly 42 enables the vanes 34 and the hub assembly 30 to be replaced after substantial wear. More particularly, removal of the vane ring 72 also removes the hub assembly 30 and all of the vanes 34. A replacement vane ring 72 together with the hub assembly 30 and a new set of vanes 34 may then be easily inserted within the inner cup 44. It is noted that the width of the vane ring 72 should be appreciably shorter than the width of the vanes 34 enabling the vanes 34 to form a seal with the wear plate 28 and the bottom 52 of the inner cup 44 of the rotor assembly 24.

Seal Unit

FIG. 1 also illustrates the seal unit 82 of the invention. More particularly, seal unit 82 comprises a seal means 84 which rotatably seals the drive shaft 20 within the sleeve 18. Means are provided for urging the seal means 84 toward the drive shaft bearing means 22 to force the seal means 84 against the proximal end 86 of the drive shaft bearing 22 and the inner surface 88 of the sleeve 18. The seal thus formed retains the lubrication for the drive shaft bearing means 22 within sleeve 18. Contamination which may build up within housing 12 will therefore be prevented from contaminating the drive shaft bearing means 22.

More particularly, seal means 84 of the seal unit 82 comprises a first collar 90 and a second collar 92 connected about the drive shaft 20. The collars 90 and 92 are rotatably connected together by a collar bearing means 94 which enables the second collar 92 to rotate with respect to the first collar 90. A resilient collar seal 96 is connected over the second collar 92 to enable the second collar 92 to sealingly engage the proximal end 86 of the drive shaft bearing 22 and the inner surface 88 of the sleeve 18.

The means for urging the seal means 84 toward the drive shaft bearing 22 comprises a helical compression spring 98. The compression spring 98 is positioned between the first collar 90 and the rotor assembly 24 and is located concentrically about the drive shaft 20 by means of a locator sleeve 100 which presses against the hub 56 of the rotor assembly 24 and a step portion 102 integrally formed with the first collar 90. During operation, the helical compression spring 98 forces the first collar 90 and correspondingly, the second collar 92 against the proximal end 86 of the drive shaft bearing 22 and the inner surface 88 of the sleeve 18. The collar seal 96 assures that an adequate seal will be formed between the proximal end 86 of the drive shaft bearing 22 and the inner surface 88 of the sleeve 18. The collar bearing means 94 enables the second collar 92 and the collar bearing means 94 to remain stationary in the sealed position during rotation of the drive shaft 20.

Hub Assembly

As noted earlier, the plurality of band-shaped vanes 34 interconnect the hub assembly 30 and the vane ring assembly 42 of the rotor assembly 24. As shown in FIGS. 3 and 4, the hub assembly 30 comprises a substantially cylindrical hub structure 106 which rotates about rotor pin 32 by means of a bearing 108 such as a needle bearing. The hub assembly 30 further includes a plurality of rotor blocks 110 each of which respectively secures the proximal end 112 of the band-shaped vanes 34 to the hub structure 106 in an overlapping manner. More specifically, by way of example, the proximal end 104B of vane 34B is placed underneath the preceding vane 34A and secured to the hub structure 106 by means of rotor block 110A. The proximal end 104B of vane 34 is also secured to the hub structure 106 by means of another rotor block 110B. This procedure is continued for each of the vanes 34 until all of the vanes 34 are secured to the hub structure 106 in at least two places in an overlapping manner with the preceding vane 34.

The rotor blocks 110 which secures the proximal ends 104 of the vanes 34 to the hub structure 106 are defined as having a bottom surface 114 curved to substantially form to the curvature of the hub structure 106, a front concave surface 116, a rear convex surface 118, an upper convex surface 120, and a left 122 and a right 124 flat side surfaces parallel with respect to one another and perpendicular to the axis of rotation of the rotor assembly 24. The rotor blocks 110 are secured to the hub structure 106 by means of a pair of threaded fasteners 126 disposed through a first aperture 128 in the rotor block 110 and a second aperture 130 in the underlying vanes 34 for threaded engagement with a threaded aperture 132 in the hub structure 106. A rotor block spacer 134 is provided for enhancing the ease of assembling the rotor blocks 110, vanes 34, threaded fasteners 126, and hub structure 106. Specifically, the rotor block spacer 134 comprises a head portion 136 and a body portion 138. A central aperture 140 is located through the center of the head portion 136 and the body portion 138 for receiving the threaded fastener 126 therethrough. The first aperture 128 of the rotor block 110 includes a counterbore portion 142 dimensioned to slidably receive the head portion 136 of the rotor block spacer 134. The threaded aperture 132 in the hub structure 106 comprises a spot face portion 144 dimensioned to slidably receive the body portion 138 of the rotor block spacer 134. Preferably, the body portion 138 of the rotor block spacer 134 has a length appreciably greater than the distance between the bottom 146 of the counterbore portion 142 of the first aperture 128 in the top 148 of the spot face portion 144 of the threaded aperture 134 when the rotor block 110, vanes 34, and the hub structure 106 are assembled together. Such length enables the body portion 138 to be located within the spot face portion 144 during assembly of the component parts of the hub assembly 30. Accordingly, the ease of assembly is greatly increased. Furthermore, rotor block spacer 134 prevents the rotor blocks 110 from being deformed in the event threaded fasteners 126 are excessively tightened.

As mentioned previously, the hub structure 106 rotates about the rotor pin 32 by means of a bearing 108. Lubrication means is provided for lubricating bearing 108 during operation of the pump. More particularly, rotor pin 32 comprises a first portion 152 for rotatable engagement with bearing 108 and a second portion 154 for connection through the end assembly 14. Preferably, the diameter of the first portion 152 is larger than the diameter of the second portion 154 enabling the rotor pin 32 to be inserted within aperture 156 in the wear plate 28 and another aperture 158 in the end assembly 14. In this manner, the larger diameter first portion 152 secures the wear plate 28 in position against end assembly 14. A central fluid communicating passageway 160 leads from the distal end of the second portion 154 of the rotor pin 32 to the side 164 of the first portion 152. A grease fitting 166 is provided for threadable engagement with the distal end 162 of rotor pin 32 by means of a rotor pin nut 168. Rotor pin nut 168 also serves to draw the first portion 152 of the rotor pin 32 against the wear plate 28 to force the wear plate 28 against housing 12. During operation of the pump,lubrication such as grease may be injected into the fluid communicating passageway 160 via grease fitting 166 to lubricate bearing 108 thereby increasing the life of the bearing 108.

Input and Output Ports

Figure 5:
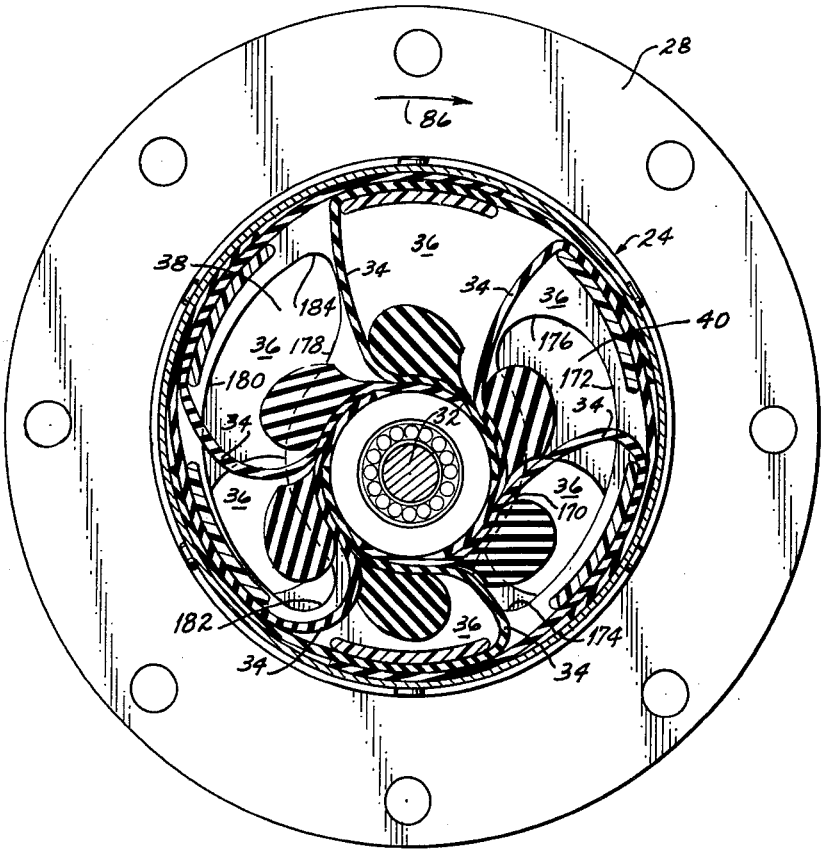
FIG. 5 is a cross-sectional view of FIG. 1 along lines 5—5 illustrating the placement of the input and output ports in relation to the plurality of pump chambers.

The input port 38 and the output port 40 are configured to enhance the pumping capability of the fluid pump 10. More particularly, as shown in FIG. 5, the output port 40 is defined by an inner edge 170 and an outer edge 172 interconnected by a lower edge 174 and an upper edge 176. Both the inner and outer edges 170 and 172 are disposed in a substantially arcuate manner about the axis of rotation of the hub assembly 30. However, the outer edge 172 is disposed apart from the inner edge 170 by a distance which increases from the lower edge 174 to the upper edge 176, thereby defining an inside area whose upper portion has an area greater than the lower portion thereof. Both the lower edge 174 and the upper edge 176 include a smooth curve which interconnects the inner and outer edges 170 and 172. Similarly, the input port 38 comprises an inner edge 178 and an outer edge 180 interconnected by a lower edge 182 and an upper edge 184. Both the inner and outer edges 178 and 180 are disposed in a substantially arcuate manner about the axis of rotation of the hub assembly 30. However, the outer edge 180 is disposed apart from the inner edge 178 by a distance which increases from the lower edge 182 to the upper edge 184, thereby defining an inside area whose upper portion has an area greater than the lower portion thereof. The lower edge 182 comprises a smooth curve which interconnects the inner and outer edges 178 and 180. The upper edge 184 comprises a smooth, yet truncated, curve which interconnects the inner and outer edges 178 and 180.

FIG. 5 also illustrates the position of the vanes 34 with respect to the input and output ports 38 and 40 in the wear plate 28. More particularly, as the rotor assembly 24 is rotated in the direction as shown by arrow 86, it can be seen that the pump chambers 36 defined by the vanes 34 cyclically increase and decrease in volume. The input port 38 is configured and positioned to be in fluid communication with the pump chambers 36 which are increasing in volume. Similarly, the output port 40 is configured and positioned to be in fluid communication with the pump chambers 36 which are decreasing in volume. Accordingly, the fluid to be pumped is drawn into the increasing-in-volume pump chambers 36 via input port 38 and then discharged, via output port 40, from those same pump chambers 36 which cyclically decrease in volume. Such pumping is caused by a low pressure created within the increasing-in-volume pump chambers 36 resulting in the fluid being forced by atmospheric pressure into those chambers. When the pump chambers 36 decrease in volume, the fluid is then forced out of the fluid pump 10 via output port 40.

Experiments have shown that the pumping action of the fluid pump 10 can be greatly increased by preventing the input and output ports 38 and 40 from both being in fluid communication with any one of the pump chambers 36 at the same time. This prevents the low pressure within the increasing-in-volume pump chambers 36 from bleeding through to the output port 40. FIG. 5 illustrates the worst case situation when a single pump chamber is disposed between the input and output ports 38 and 40. As shown, it can be seen that when a pump chamber 36 changes from a decreasing to an increasing-in-volume pump chamber, that pump chamber is not in fluid communication with either the input port 38 or the output port 40. Similarly, when a pump chamber 36 is changing from increasing to a decreasing-in-volume pump chamber, that pump chamber 36 is not in fluid communication with either the input or the output ports 38 and 40. Accordingly, the low pressure created within the increasing-in-volume pump chambers 36 cannot leak through to the output port 40. This enables the fluid pump 10 to be self-priming.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, What is claimed is:

1. A fluid pump for pumping a fluid from an input conduit to an output conduit, comprising in combination:

a housing;

a cup-shaped rotor assembly rotatably disposed within said housing;

a rotatable vane ring assembly slidably disposed within said rotor assembly;

means for engaging said vane ring assembly within said rotor assembly to prevent said vane ring assembly from rotating within said rotor assembly;

a hub assembly disposed within said vane ring assembly;

means for positioning the axis of said hub assembly in a position parallel and eccentric to the axis of rotation of said vane ring assembly;

a wear plate in juxtaposition with the open end of said rotor assembly;

a plurality of band-shaped vanes interconnecting said vane ring assembly and said hub assembly;

said vanes being disposed in a spaced-apart relationship parallel to the axis of rotation of said vane ring assembly to form a plurality of pump chambers;

each of said pump chambers being defined by two said vanes, the bottom of said rotor assembly, and the inner surface of said wear plate whereby the volume of said pump chambers sequentially increase and decrease as said vane ring assembly is rotated;

an input port connected in fluid communication with said pump chambers when said pump chambers are increasing in volume as said vane ring assembly is rotated;

an output port connected in fluid communication with said pump chambers when said pump chambers are decreasing in volume as said vane ring assembly is rotated;

means for connecting said input port to the input conduit; and means for connecting said output port to the output conduit.

2. The fluid pump as set forth in claim 1, wherein said means for engaging said vane ring assembly within said rotor assembly to prevent said vane ring assembly from rotating within said rotor assembly comprises a protuberance disposed exteriorly from said vane ring assembly for engagement with a corresponding indentation in the interior of said rotor assembly.

3. The fluid pump as set forth in claim 1, wherein said vane ring assembly comprises a substantially cylindrical member dimensioned to be slidably inserted within said rotor assembly.

4. The fluid pump as set forth in claim 3, wherein said cylindrical member has a length appreciably smaller than the width of said vanes thereby enabling said vanes to form a seal with said wear plate and the bottom of said rotor assembly.

5. A fluid pump for pumping a fluid from an input conduit to an output conduit, comprising in combination:

a housing;

a cup-shaped rotor assembly rotatably disposed within said housing;

a vane ring assembly slidably disposed within said rotor assembly, means for engaging said vane ring assembly within said rotor assembly to prevent said vane ring assembly from rotating within said rotor assembly;

said means for engaging said vane ring assembly comprising a protuberance disposed exteriorly from said vane ring assembly for engagement with a corresponding indentation in the interior of said rotor assembly;

a hub assembly disposed within said vane ring assembly;

means for positioning the axis of said hub assembly in a position parallel and eccentric to the axis of rotation of said vane ring assembly;

a wear plate in juxtaposition with the open end of said rotor assembly;

a plurality of band-shaped vanes interconnecting said vane ring assembly and said hub assembly;

said vanes being disposed in a spaced-apart relationship parallel to the axis of rotation of said vane ring assembly to form a plurality of pump chambers;

each of said pump chambers being defined by two said vanes, the bottom of said rotor assembly, and the inner surface of said wear plate whereby the volume of said pump chambers sequentially increase and decrease as said vane ring assembly is rotated;

said protuberance comprising the end of a fastener means which secures the distal end of one of said vanes to said vane ring assembly;

an input port connected in fluid communication with said pump chambers when said pump chambers are increasing in volume as said vane ring assembly is rotated;

an output port connected in fluid communication with said pump chambers when said pump chambers are decreasing in volume as said vane ring assembly is rotated;

means for connecting said input port to the input conduit; and means for connecting said output port to the output conduit.

6. A fluid pump for pumping a fluid from an input conduit to an output conduit, comprising in combination:

a housing;

a cup-shaped rotor assembly rotatably disposed within said housing;

an outer cup of said rotor assembly;

an inner cup disposed within said outer cup;

a hub interconnecting said outer cup and said inner cup;

a drive shaft rotatably disposed within said housing;

means for rigidly connecting said hub to said drive shaft enabling said rotor assembly to be rotated when said drive shaft is rotated;

a vane ring assembly slidably disposed within said rotor assembly;

means for engaging said vane ring assembly within said rotor assembly to prevent said vane ring assembly from rotating within said rotor assembly;

a hub assembly disposed within said vane ring assembly;

means for positioning the axis of said hub assembly in a position parallel and eccentric to the axis of rotation of said vane ring assembly;

a wear plate in juxtaposition with the open end of said rotor assembly;

a plurality of band-shaped vanes interconnecting said vane ring assembly and said hub assembly;

said vanes being disposed in a spaced-apart relationship parallel to the axis of rotation of said vane ring assembly to form a plurality of pump chambers;

each of said pump chambers being defined by two said vanes, the bottom of said rotor assembly, and the inner surface of said wear plate whereby the volume of said pump chambers sequentially increase and decrease as said vane ring assembly is rotated;

an input port connected in fluid communication with said pump chambers when said pump chambers are increasing in volume as said vane ring assembly is rotated;

an output port connected in fluid communication with said pump chambers when said pump chambers are decreasing in volume as said vane ring assembly is rotated;

means for connecting said input port to the input conduit; and means for connecting said output port to the output conduit.

7. A fluid pump for pumping a fluid from an input conduit to an output conduit, comprising in combination:

a housing;

a cup-shaped rotor assembly rotatably disposed within said housing;

an outer cup of said rotor assembly;

an inner cup disposed within said outer cup;

a hub interconnecting said outer cup and said inner cup;

a drive shaft rotatably disposed within said housing;

means for rigidly connecting said hub to said drive shaft enabling said rotor assembly to be rotated when said drive shaft is rotated;

a vane ring assembly slidably disposed within said rotor assembly;

means for engaging said vane ring assembly within said rotor assembly to prevent said vane ring assembly from rotating within said rotor assembly;

a hub assembly disposed within said vane ring assembly;

means for positioning the axis of said hub assembly in a position parallel and eccentric to the axis of rotation of said vane ring assembly;

a wear plate in juxtaposition with the open end of said rotor assembly;

a plurality of band-shaped vanes interconnecting said vane ring assembly and said hub assembly;

said vanes being disposed in a spaced-apart relationship parallel to the axis of rotation of said vane ring assembly to form a plurality of pump chambers;

each of said pump chambers being defined by two said vanes, the bottom of said rotor assembly, and the inner surface of said wear plate whereby the volume of said pump chambers sequentially increase and decrease as said vane ring assembly is rotated;

said inner cup comprising a smooth, flat bottom portion which acts as a wear surface for said vanes defining said pump chambers;

an input port connected in fluid communication with said pump chambers when said pump chambers are increasing in volume as said vane ring assembly is rotated;

an output port connected in fluid communication with said pump chambers when said pump chambers are decreasing in volume as said vane ring assembly is rotated;

means for connecting said input port to the input conduit; and means for connecting said output port to the output conduit.

8. A fluid pump for pumping a fluid from an input conduit to an output conduit, comprising in combination:

a housing;

a cup-shaped rotor assembly rotatably disposed within said housing;

an outer cup of said rotor assembly;

an inner cup disposed within said outer cup;

a hub interconnecting said outer cup and said inner cup;

a drive shaft rotatably disposed within said housing;

means for rigidly connecting said hub to said drive shaft enabling said rotor assembly to be rotated when said drive shaft is rotated, said means for rigidly connecting said hub to said drive shaft comprising said hub including a major hub portion interconnecting said outer cup and said inner cup and a minor hub portion which extends through an aperture in the bottom of said outer cup for connection to said drive shaft and a fastener means for connecting said minor hub portion to the end of said drive shaft;

a vane ring assembly slidably disposed within said rotor assembly;

means for engaging said vane ring assembly within said rotor assembly to prevent said vane ring assembly from rotating within said rotor assembly;

a hub assembly disposed within said vane ring assembly;

means for positioning the axis of said hub assembly in a position parallel and eccentric to the axis of rotation of said vane ring assembly;

a wear plate in juxtaposition with the open end of said rotor assembly;

a plurality of band-shaped vanes interconnecting said vane ring assembly and said hub assembly;

said vanes being disposed in a spaced-apart relationship parallel to the axis of rotation of said vane ring assembly to form a plurality of pump chambers;

each of said pump chambers being defined by two said vanes, the bottom of said rotor assembly, and the inner surface of said wear plate whereby the volume of said pump chambers sequentially increase and decrease as said vane ring assembly is rotated;

an input port connected in fluid communication with said pump chambers when said pump chambers are increasing in volume as said vane ring assembly is rotated;

an output port connected in fluid communication with said pump chambers when said pump chambers are decreasing in volume as said vane ring assembly is rotated;

means for connecting said input port to the input conduit; and means for connecting said output port to the output conduit.

9. A fluid pump for pumping a fluid from an input conduit to an output conduit, comprising in combination:

a housing;

a cup-shaped rotor assembly rotatably disposed within said housing;

an outer cup of said rotor assembly;

an inner cup disposed within said outer cup;

a hub interconnecting said outer cup and said inner cup;

a drive shaft rotatably disposed within said housing;

means for rigidly connecting said hub to said drive shaft enabling said rotor assembly to be rotated when said drive shaft is rotated, said means for rigidly connecting said hub to said drive shaft comprising said hub including a major hub portion interconnecting said outer cup and said inner cup and a minor hub portion which extends through an aperture in the bottom of said outer cup for connection to said drive shaft and a fastener means for connecting said minor hub portion to the end of said drive shaft, said fastener means comprising a roll pin which engages through an aperture in said minor hub portion and a corresponding aperture in said drive shaft;

a vane ring assembly slidably disposed within said rotor assembly;

means for engaging said vane ring assembly within said rotor assembly to prevent said vane ring assembly from rotating within said rotor assembly;

a hub assembly disposed within said vane ring assembly;

means for positioning the axis of said hub assembly in a position parallel and eccentric to the axis of rotation of said vane ring assembly;

a wear plate in juxtaposition with the open end of said rotor assembly;

a plurality of band-shaped vanes interconnecting said vane ring assembly and said hub assembly;

said vanes being disposed in a spaced-apart relationship parallel to the axis of rotation of said vane ring assembly to form a plurality of pump chambers;

each of said pump chambers being defined by two said vanes, the bottom of said rotor assembly, and the inner surface of said wear plate whereby the volume of said pump chambers sequentially increase and decrease as said vane ring assembly is rotated;

an input port connected in fluid communication with said pump chambers when said pump chambers are increasing in volume as said vane ring assembly is rotated;

an output port connected in fluid communication with said pump chambers when said pump chambers are decreasing in volume as said vane ring assembly is rotated;

means for connecting said input port to the input conduit; and means for connecting said output port to the output conduit.

10. A fluid pump for pumping a fluid from an input conduit to an output conduit, comprising in combination:

a housing;

a cup-shaped rotor assembly rotatably disposed within said housing;

an outer cup of said rotor assembly;
an inner cup disposed within said outer cup;
a hub interconnecting said outer cup and said inner cup;
said outer cup and said inner cup being interconnected together by welding said outer cup and said inner cup to said hub located therebetween;
a drive shaft rotatably disposed within said housing;
means for rigidly connecting said hub to said drive shaft enabling said rotor assembly to be rotated when said drive shaft is rotated;
a vane ring assembly slidably disposed within said rotor assembly;
means for engaging said vane ring assembly within said rotor assembly to prevent said vane ring assembly from rotating within said rotor assembly;
a hub assembly disposed within said vane ring assembly;
means for positioning the axis of said hub assembly in a position parallel and eccentric to the axis of rotation of said vane ring assembly;
a wear plate in juxtaposition with the open end of said rotor assembly;
a plurality of band-shaped vanes interconnecting said vane ring assembly and said hub assembly;
said vanes being disposed in a spaced-apart relationship parallel to the axis of rotation of said vane ring assembly to form a plurality of pump chambers;
each of said pump chambers being defined by two said vanes, the bottom of said rotor assembly, and the inner surface of said wear plate whereby the volume of said pump chambers sequentially increase and decrease as said vane ring assembly is rotated;
an input port connected in fluid communication with said pump chambers when said pump chambers are increasing in volume as said vane ring assembly is rotated;
an output port connected in fluid communication with said pump chambers when said pump chambers are decreasing in volume as said vane ring assembly is rotated;
means for connecting said input port to the input conduit; and
means for connecting said output port to the output conduit.

11. A fluid pump for pumping a fluid from an input conduit to an output conduit, comprising in combination:
a housing including a sleeve;
a drive shaft;
a drive shaft bearing means disposed within said sleeve enabling said drive shaft to rotate therein;
seal means for rotatably sealing said drive shaft in said sleeve;
means for urging said seal means toward said drive shaft bearing means to force said seal means against the proximal end of said drive shaft bearing means and the inner surface of said sleeve;
a cup-shaped rotor assembly rotatably disposed within said housing;
means for connecting said rotor assembly to the proximal end of said drive shaft;
a rotatable vane ring assembly slidably disposed within said rotor assembly;
means for engaging said vane ring assembly within said rotor assembly to prevent said vane ring assembly from rotating within said rotor assembly;
a hub assembly disposed within said rotor assembly;
means for positioning the axis of said hub assembly parallel and eccentric to the axis of rotation of said rotor assembly;
a wear plate in juxtaposition with the open end of said rotor assembly;
a plurality of band-shaped vanes interconnecting said vane ring assembly and said hub assembly;
said vanes being disposed in a spaced-apart relationship parallel to the axis of rotation of said rotor assembly to form a plurality of pump chambers;
each of said pump chambers being defined by two said vanes, the bottom of said rotor assembly, and the inner surface of said wear plate whereby the volume of said pump chambers sequentially increase and decrease as said rotor assembly is rotated;
an input port connected in fluid communication with said pump chambers when said pump chambers are increasing in volume as said rotor assembly is rotated;
an output port connected in fluid communication with said pump chambers when said pump chambers are decreasing in volume as said rotor assembly is rotated;
means for connecting said input port to the input conduit; and
means for connecting said output port to the output conduit.

12. The fluid pump as set forth in claim 11, wherein said urging means comprises a spring means operatively positioned to urge said seal means against said drive shaft bearing means.

13. The fluid pump as set forth in claim 12, wherein said spring means comprises a helical compression spring positioned concentrically about said drive shaft between said seal means and said rotor assembly.

14. The fluid pump as set forth in claim 13, wherein said seal means comprises in combination:
a first collar located about said drive shaft;
a second collar located in rotatable engagement about said drive shaft;
a collar bearing means interconnecting said first collar and said second collar enabling said second collar to rotate with respect to said first collar;
a resilient collar seal connected to said second collar enabling said second collar to sealingly engage the proximal end of said drive shaft bearing means and the inner surfae of said sleeve;
said helical compression spring being positioned between said first collar and said rotor assembly to urge said first collar and correspondingly, said second collar toward said drive shaft bearing means enabling said resilient collar seal connected to said second collar to form a seal with the proximal end of said drive shaft bearing means and the inner surface of said sleeve;
said collar bearing means enabling said second collar to rotate with respect to said first collar and to said drive shaft to prevent the seal formed between said second collar and the proximal end of said drive shaft bearing means and the inner surface of said sleeve from being broken during rotation of said drive shaft.

15. The fluid pump as set forth in claim 14, further including a locator sleeve connected to said rotor assembly for locating said helical compression spring concentrically about said drive shaft.

16. The fluid pump as set forth in claim 15, wherein said first collar includes a step portion for locating said helical compression spring concentrically about said drive shaft.

17. A fluid pump for pumping a fluid from an input conduit to an output conduit, comprising in combination:

a housing;

a cup-shaped rotor assembly rotatably disposed within said housing;

a rotatable vane ring assembly slidably disposed within said rotor assembly;

means for engaging said vane ring assembly within said rotor assembly to prevent said vane ring assembly from rotating within said rotor assembly;

a hub assembly disposed within said rotor assembly;

means for positioning the axis of said hub assembly in a position parallel and eccentric to the axis of rotation of said rotor assembly;

a wear plate in juxtaposition with the open end of said rotor assembly;

a plurality of band-shaped vanes interconnecting said rotor assembly and said hub assembly;

said hub assembly including a hub structure and a plurality of rotor blocks, each of which secures the proximal end of one of said vanes to said hub structure;

said rotor block being defined as having a bottom surface curved to substantially conform to the curvature of said hub structure, a front concave surface, a rear convex surface, an upper convex surface, and left and right flat side surfaces parallel with respect to one another and perpendicular to the axis of rotation of said rotor assembly;

said vanes being disposed in a spaced-apart relationship parallel to the axis of rotation of said rotor assembly to form a plurality of pump chambers;

each of said pump chambers being defined by two said vanes, the bottom of said rotor assembly, and the inner surface of said wear plate whereby the volume of said pump chambers sequentially increase and decrease as said rotor assembly is rotated;

an input port connected in fluid communication with said pump chambers when said pump chambers are increasing in volume as said rotor assembly is rotated;

an output port connected in fluid communication with said pump chambers when said pump chambers are decreasing in volume as said rotor assembly is rotated;

means for connecting said input port to the input port conduit; and means for connecting said output port to the output port conduit.

18. The fluid pump as set forth in claim 17, wherein each said rotor block is secured to said hub structure by a threaded fastener means disposed through a first aperture in said rotor block and a second aperture in said vane for threaded engagement with a threaded aperture in said hub structure.

19. A fluid pump for pumping a fluid from an input conduit to an output conduit, comprising in combination:

a housing;

a cup-shaped rotor assembly rotatably disposed within said housing;

a rotatable vane ring assembly slidably disposed within said rotor assembly;

means for engaging said vane ring assembly within said rotor assembly to prevent said vane ring assembly from rotating within said rotor assembly;

a hub assembly disposed within said rotor assembly;

means for positioning the axis of said hub assembly in a position parallel and eccentric to the axis of rotation of said rotor assembly;

a wear plate in juxtaposition with the open end of said rotor assembly;

a plurality of band-shaped vanes interconnecting said rotor assembly and said hub assembly;

said hub assembly including a hub structure and a plurality of rotor blocks, each of which secures the proximal end of one of said vanes to said hub structure;

said rotor block being defined as having a bottom surface curved to substantially conform to the curvature of said hub structure, a front concave surface, a rear convex surface, an upper convex surface, and left and right flat side surfaces parallel with respect to one another and perpendicular to the axis of rotation of said rotor assembly, said rotor block secured to said hub structure by a threaded fastener means being disposed through a first aperture in said rotor block and a second aperture in said vane for threaded engagement with a threaded aperture in said hub structure;

a rotor block spacer including a head portion and a body portion and a central aperture for receiving said threaded fastener means therethrough;

said first aperture of said rotor block including a counterbore portion dimensioned to slidably receive said head portion of said rotor block spacer;

said threaded aperture in said hub structure including a spot face portion dimensioned to slidably receive said body portion of said rotor block spacer;

said body portion of said rotor block spacer having a length appreciably greater than the distance between the bottom of said counterbore portion of said first aperture and the top of said spot face portion of said threaded aperture when said rotor block, said vanes, and said hub structure are assembled together;

said vanes being disposed in a spaced-apart relationship parallel to the axis of rotation of said rotor assembly to form a plurality of pump chambers;

each of said pump chambers being defined by two said vanes, the bottom of said rotor assembly, and the inner surface of said wear plate whereby the volume of said pump chambers sequentially increase and decrease as said rotor assembly is rotated;

an input port connected in fluid communication with said pump chambers when said pump chambers are increasing in volume as said rotor assembly is rotated;

an output port connected in fluid communication with said pump chambers when said pump chambers are decreasing in volume as said rotor assembly is rotated;

means for connecting said input port to the input port conduit; and means for connecting said output port to the output port conduit.

20. A fluid pump for pumping a fluid from an input conduit to an output conduit, comprising in combination;

a housing having one end open;

a cup-shaped rotor assembly rotatably disposed within said housing;

a rotatable vane ring assembly slidably disposed within said rotor assembly;

means for engaging said vane ring assembly with said rotor assembly to prevent said vane ring assembly from rotating with said rotor assembly;

a hub assembly disposed within said rotor assembly;

a plurality of band-shaped vanes interconnecting said rotor assembly and said hub assembly;

said hub assembly including a hub structure having a bearing means installed therein and a plurality of rotor blocks each of which secures the proximal end of one of said vanes to said hub structure;

a wear plate;

an end assembly securable to the open end of said housing to position said wear plate in juxtaposition with the open end of said rotor assembly;

a rotor pin having a first portion for rotatable engagement with said bearing means and a second portion for connection to said end assembly;

said rotor pin being rigidly secured by said end assembly to position the axis of said rotor pin parallel and eccentric to the axis of rotation of said rotor assembly;

said rotor pin including a central fluid communicating passageway leading from the digital end of said second portion of said rotor pin to the side of first portion of said rotor pin enabling a lubricant to be injected into said rotor pin to lubricate said bearing means;

said vanes being disposed in a spaced-apart relationship parallel to the axis of rotation of said rotor assembly to form a plurality of pump chambers;

each of said pump chambers being defined by two vanes, the bottom of said rotor assembly, and the inner surface of said wear plate whereby the volume of said pump chamber sequentially increase and decrease as said rotor assembly is rotated;

an input port connected in fluid communication with said pump chambers when said pump chambers are increasing in volume as said rotor assembly is rotated;

an output port connected in fluid communication with said pump chambers when said pump chambers are decreasing in volume as said rotor assembly is rotated;

means for connecting said input port to the input conduit; and means for connecting said output port to the output conduit.

21. The fluid pump as set forth in claim 20, further including a grease fitting secured to the terminus end of said second portion of said rotor pin enabling a lubricant to be injected into said passageway for lubricating said bearing means.

22. The fluid pump as set forth in claim 21, wherein said grease fitting is secured to the terminus end of said second portion of said rotor pin by means of a rotor pin nut which threadably engages said second portion and said grease fitting.

23. A fluid pump for pumping a fluid from an input conduit to an output conduit, comprising in combination:

a housing;

a cup-shaped rotor assembly rotatably disposed within said housing;

a rotatable vane ring assembly slidably disposed within said rotor assembly;

means for engaging said vane ring assembly with said rotor assembly to prevent said vane ring assembly from rotating with said rotor assembly;

a hub assembly disposed within said rotor assembly;

means for positioning the axis of said hub assembly in a position parallel and eccentric to the axis of rotation of said rotor assembly;

a wear plate in juxtaposition with the open end of said rotor assembly;

a plurality of band-shaped vanes interconnecting said rotor assembly and said hub assembly;

said hub assembly including a hub structure and a plurality of rotor blocks, each of which secures the proximal end of one of said vanes to said hub structure;

said vanes being disposed in a spaced-apart relationship parallel to the axis of rotation of said rotor assembly to form a plurality of pump chambers;

each of said pump chambers being defined by two said vanes, the bottom of said rotor assembly, and the inner surface of said wear plate whereby the volume of said pump chambers cyclically increase and decrease as said rotor assembly is rotated;

an input port connected in fluid communication with said pump chambers when said pump chambers are increasing in volume as said rotor assembly is rotated;

an output port connected in fluid communication with said pump chambers when said pump chambers are decreasing in volume as said rotor assembly is rotated;

said input port and said output port being positioned apart from one another in a substantially arcuate manner about the axis of rotation of said hub assembly such that said input port and said output port are not both in fluid communication with the same said pump chamber at the same instant of time as said hub assembly is rotated;

means connecting said input port to the input conduit; and means for connecting said output port to the output conduit.

24. The fluid pump as set forth in claim 23, wherein said input port and said output port each includes an inside area whose upper portion has an area greater than the lower portion thereof.

25. The fluid pump as set forth in claim 23, wherein said input port and said output port each includes an inside area whose upper portion has a width longer than the lower portion thereof.

* * * * *